United States Patent [19]

Richter et al.

[11] Patent Number: 4,941,409

[45] Date of Patent: Jul. 17, 1990

[54] WHEEL SET GUIDANCE FOR TRUCKS OF RAIL VEHICLES, ESPECIALLY COMMUTER TRAFFIC VEHICLES

[75] Inventors: Wolfgang-Dieter Richter, Winkelhaid; Engelbert Weeger, Nuremberg; Lutz Uebel, Heroldsberg; Erhard Foerster, Lilienthal, all of Fed. Rep. of Germany

[73] Assignees: MAN Gutehoffnungshütte AG, Oberhausen; Bremer Strassenbahn AG, Bremen, both of Fed. Rep. of Germany

[21] Appl. No.: 323,635

[22] Filed: Mar. 15, 1989

[30] Foreign Application Priority Data

Mar. 15, 1988 [DE] Fed. Rep. of Germany ..... 3808593

[51] Int. Cl.[5] ..... B61F 3/08; B61F 5/30

[52] U.S. Cl. ..... 105/157.1; 105/158.2; 105/218.2

[58] Field of Search ..... 105/157.1, 158.2, 175.1, 105/179, 218.1, 133, 180, 132.1, 214, 98, 218.2, 223, 224.05, 224.06

[56] References Cited

U.S. PATENT DOCUMENTS 3,859,927 1/1975 Pelabon ..... 105/98
4,294,175 10/1981 Harsy ..... 105/218.2

FOREIGN PATENT DOCUMENTS 0183619 6/1986 European Pat. Off. ..... 105/157.1
2144157 3/1973 Fed. Rep. of Germany .
1431736 2/1966 France ..... 105/218.2

OTHER PUBLICATIONS

Journal for the Improvement of Railway Systems, Issue 17/18, Sep. 1942, pp. 268–273 (no traslation available).

*Primary Examiner*—Andres Kashnikow
*Assistant Examiner*—Mark T. Le
*Attorney, Agent, or Firm*—Robert W. Becker & Associates

[57] ABSTRACT

A wheel set guidance for trucks of rail vehicles, especially commuter traffic vehicles. To have a continuously extending floor on as low a level as possible, a truck with free wheels is proposed where the free wheels are mounted in pedestal bearings that are connected with a frame structure that is connected to the truck frame in such a way as to be pivotable in a vertical direction. One of the wheel sets can be driven, with the free wheels thereof being connected in a twist-resistant manner via gear arrangement, so that from a motion standpoint the same effect is achieved as if the driven wheel set were connected with a rigid wheel set shaft, but without this shaft being in the way of the floor, so that a vehicle equipped with this truck can have a continuously extending floor on a low level.

3 Claims, 2 Drawing Sheets

WHEEL SET GUIDANCE FOR TRUCKS OF RAIL VEHICLES, ESPECIALLY COMMUTER TRAFFIC VEHICLES

BACKGROUND OF THE INVENTION

1. Field of the Invention

The present invention relates to a wheel set guidance for trucks of rail vehicles, especially commuter traffic vehicles, with the wheels of a given wheel set being pivotably connected with a cross-beam or member of a truck frame via a frame structure about an axis of rotation that is disposed horizontally and transverse to the direction of travel, and with primary springs being provided between the frame structures or wheel set bearings and longitudinal members of the truck frame, whereby a car body is also spring-suspended relative to the longitudinal members of the truck frame via secondary springs.

2. Description of the Prior Art

German Offenlegungsschrift No. 21 44 157 Kayserling dated Mar. 15, 1973, belonging to Maschinenfabrik Augsburg-Nürnberg AG, discloses, for the guidance of wheel sets in trucks of rail vehicles, guidance of the wheel set via a frame structure on a cross member of a truck frame in such a way that the wheel set can carry out pivoting movements in a vertical direction. The wheels of each wheel set are in this case connected in a twist-resistant manner via a wheel set shaft. The primary spring-suspension of the wheel set relative to the truck frame is effected via coil springs on both sides of an axle-box housing. Such a wheel set guidance has the drawback that the continuous wheel set shaft stands in the way of the use of a low-lying floor.

It is furthermore known to embody a truck having one wheel set with a free wheel design and the other wheel set with a continuous wheel set shaft.

The drawback of this construction is the continuous shaft of the one wheel set, which shaft stands in the way of a low-lying floor (Journal for the Improvement of Railway systems, Issue 17/18, Sept. 1942, Pages 268–273).

SUMMARY OF THE INVENTION

In contrast to the truck of the aforementioned type, it is an object of the present invention to embody a rail truck in such a way that a continuously extending floor can be used that is disposed on a low level, and that at the same time the guidance characteristic of wheel sets having continuous wheel set shafts is to a large extent retained.

The wheel set guidance of the present invention is characterized primarily in that all four wheels of the truck are embodied as free wheels, with each two of these free wheels forming a wheel set, in that each free wheel is connected to the frame structure in a stable manner via pedestal bearings, whereby the frame structure, which has a U-shaped and twist-resistant box girder section, is connected, on two mountings in the vicinity of the longitudinal members and within the same, to a respective cross member in such a way as to be pivotable in a vertical direction, and in that the free wheels of one of the wheel sets are interconnected in a twist-resistant manner via gear means and can be driven by a drive motor.

By the strict use of free wheels on both of the wheel sets, a floor of the car body can extend continuously on a low level, since the wheel set shafts are eliminated.

The disadvantageous contact of the flanges of the loose wheels against the rails in the absence of guidance by the tapered contact surfaces of the wheels that are interconnected in a twist-resistant manner is considerably reduced by the present invention in that one of the wheel sets is driven and the two free wheels are connected in a twist-resistant manner by gear means, i.e. as if a wheel set shaft were present.

Further specific features and objects of the present invention will be described in detail subsequently.

BRIEF DESCRIPTION OF THE DRAWINGS

This object, and other objects and advantages of the present invention, will appear more clearly from the following specification in conjunction with the accompanying schematic drawings, in which.

DESCRIPTION OF THE PREFERRED EMBODIMENTS

Figure 1:
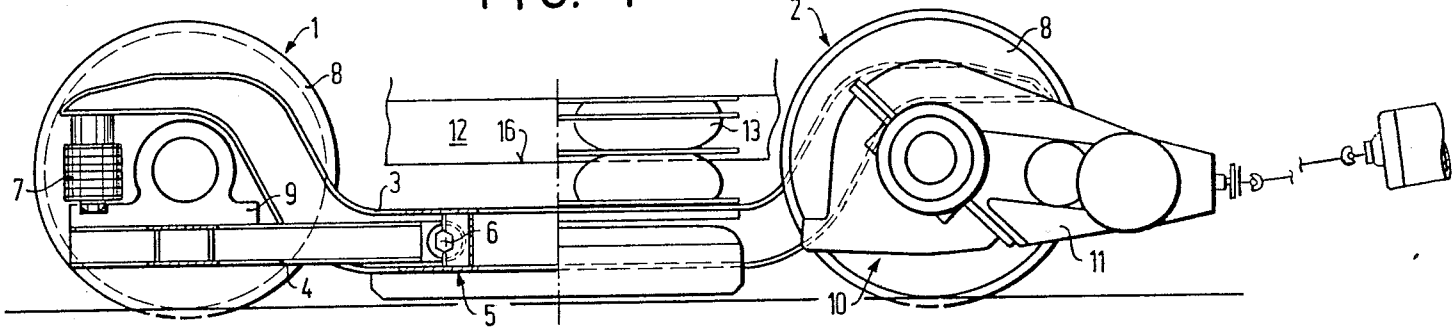
FIG. 1 is a side view, in conformity with section I—I in FIG. 2, of a truck having a frame structure and gear means.

Referring now to the drawings in detail, a rail truck, especially for multi-unit streetcar or bus vehicles, is illustrated in side view in FIG. 1. Two wheel sets 1 and 2 are disposed in a truck frame 3. Guidance of the wheel sets is inventively effected by a frame structure 4 that is connected to the truck frame 3 by means of a resilient joint or coupling 5 in such a way that the frame structure 4 can carry out vertical rotational movements about a horizontally disposed axis of rotation 6. The frame structure 4 is spring-suspended relative to the truck frame 3 via primary springs 7. The wheel sets 1 and 2 are embodied as free wheels 8 that are connected to the frame structure 4 in pedestal bearings 9 in a stable manner. For this purpose, the frame structure 4 is embodied as a twist-resistant box girder section. When viewed in the direction of travel, the couplings 5 are rigid, yet are soft with regard to twisting of the frame structure 4 relative to the truck frame 3, as occurs when traversing uneven tracks. In the illustrated embodiment, the truck comprises the non-driven wheel set 1 and the driven wheel set 2. The transfer of torque from a non-illustrated drive motor to the wheel set 2 is effected via a similarly non-illustrated Cardan shaft and gear means 10 that are embodied as a reduction gear 11 that is connected at one end to a respective free wheel 8.

To provide shock absorption, a car body 12 is spring suspended relative to the truck frame 3 via secondary springs 13. In this connection, the secondary springs 13 can preferably be embodied as rubber spring means.

Figure 2:
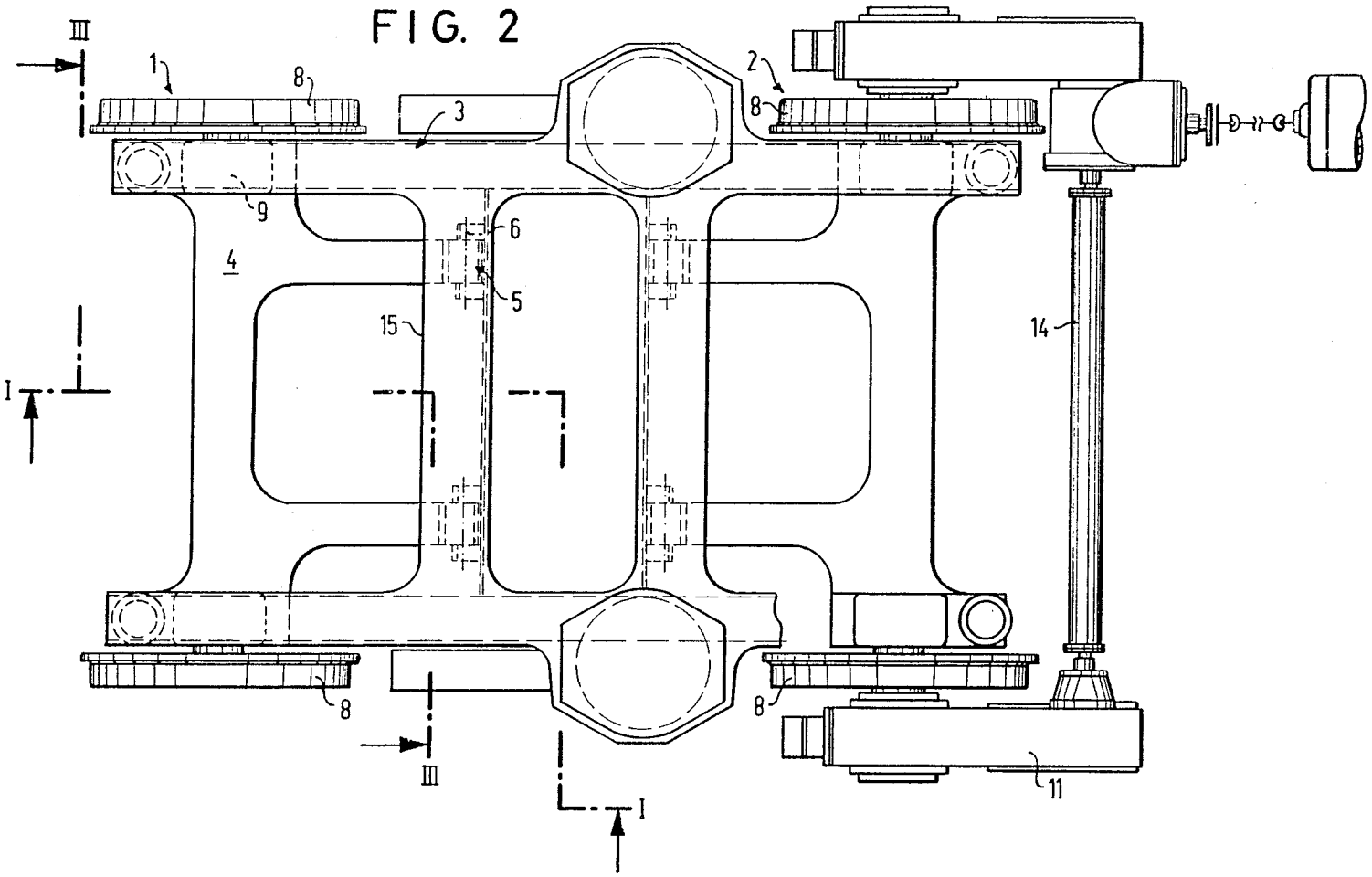
FIG. 2 is a plan view of the truck.

FIG. 2 shows a plan view of the truck. The free wheels 8 of the wheel sets 1 and 2 are connected in a stable manner via the pedestal bearings 9 with the twist-resistant frame structure 4, which is connected to the cross-beam or member 15 of the truck frame 3 via zero-wear joints or couplings 5. The free wheels 8 of the driven wheel set 2 are driven by respective reduction gears 11. Pursuant to the present invention, the two reduction gears 11 are connected in a twist-resistant manner by a connecting shaft 14. By means of the connecting shaft 14, the same effect is achieved as if the two free wheels 8 of the wheel set 2 were directly connected by a wheel set shaft. However, the space between the free wheels 8 remains free for a low-lying, continuous floor 16 of the car body 12 (FIG. 1). Due to the quasit-wist-resistant connection of the free wheels 8, the disadvantageous contact of the free wheels 8 on the rails is avoided, since the sine curve known with rigid wheel sets occurs in a flat shape.

Figure 3:
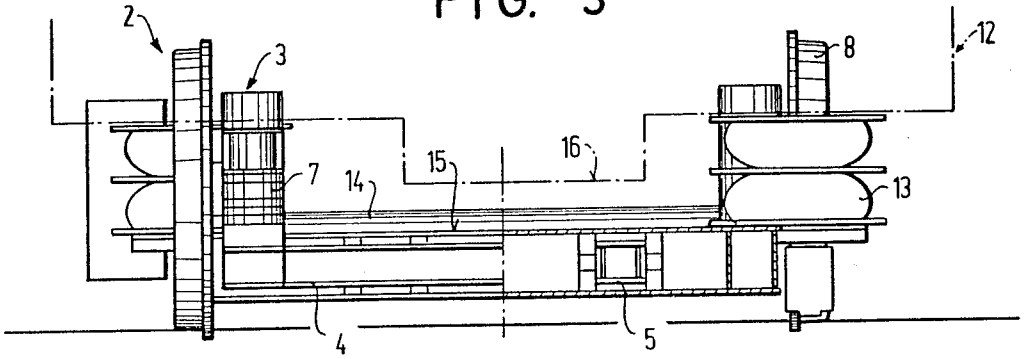
FIG. 3 is a cross-sectional view taken along line III—III of FIG. 2.

An end view of the truck, partially as in section along a line III—III, is illustrated in FIG. 3. The frame structure 4 is connected to the cross member 15 of the truck frame 3 by the couplings 5 in such a way that the frame structure 4 is pivotable in a vertical direction. The frame structure 4 is spring-suspended via the primary springs 7 relative to the truck frame 3, which in turn is spring-suspended by the secondary springs 13 relative to the car body 12. The primary springs 7 are embodied as rubber/metal composite springs.

By embodying the wheels as free wheels 8, and by transferring the torque of a non-illustrated drive motor to the free wheels of the wheel set 2 via the connecting shaft 14, the floor 16 can be low-lying throughout its entire length.

The present invention is, of course, in no way restricted to the specific disclosure of the specification and drawings, but also encompasses any modifications within the scope of the appended claims.

What is claimed is:

1. In a wheel set guidance for trucks of rail vehicles, especially commuter traffic vehicles, which includes a first wheel set and a second wheel set, with the wheels of a given one of said wheel sets being pivotably connected with a cross-member of a truck frame via a respective frame structure about an axis of rotation that is disposed horizontally and transverse to the direction of travel, and with primary springs being provided between said frame structures and longitudinal members of said truck frame, whereby a car body is also spring-suspended relative to said longitudinal members of said truck frame via secondary springs, the improvement therewith wherein:

said truck is provided with four wheels, which are embodied as free wheels in which each of said wheels is independently connected to said frame structure by a separate short axle, with two of said free wheels forming said first wheel set, and two other of said free wheels forming said second wheel set;

each of said free wheels is connected to said frame structure by a secure-against-tilt and tip-resistant means via a pedestal bearing;

each of said frame structures has a U-shaped and twist-resistant torsionally-stiff box girder section and is connected, in the vicinity of said longitudinal members and within the same, via two mountings to a respective one of said cross-members of said truck frame in such a way as to be pivotable in a vertical direction; and said free wheels of said second wheel set are interconnected by means to preclude any independent rotating thereof including a torsionally-stiff arrangement via gear means and also adapted to be driven by a drive motor.

2. A wheel set guidance according to claim 1, in which said two mounting for each of said frame structures are structurally rigid means in the direction of travel, yet are resilient and yielding means with regard to twisting and torsional movement of said frame structures relative to said truck frame.

3. A wheel set guidance according to claim 1, in which said gear means includes, for each of said free wheels of said second wheel set, a respective reduction gear means that has an end connected to its associated free wheel, with said two reduction gear means being interconnected in a structurally twist-resistant and torsionally stiff manner via a transfer shaft, and with one of said reduction gear means furthermore being structurally connected with a drive motor via a Cardan shaft.

* * * * *